United States Patent [19]

Drothen et al.

[11] Patent Number: 4,523,172

[45] Date of Patent: Jun. 11, 1985

[54] HIGH VOLTAGE QUICK-BREAK FUSE

[75] Inventors: Michael Drothen; Willi Ressel, both of Witten, Fed. Rep. of Germany

[73] Assignee: Wickmann Werke GmbH, Witten, Fed. Rep. of Germany

[21] Appl. No.: 539,696

[22] Filed: Oct. 6, 1983

[30] Foreign Application Priority Data

Oct. 8, 1982 [DE] Fed. Rep. of Germany ..... 3237326

[51] Int. Cl.[3] ..... H01H 85/04

[52] U.S. Cl. ..... 337/164; 337/161

[58] Field of Search ..... 337/162, 161, 159, 158, 337/164, 292

[56] References Cited

U.S. PATENT DOCUMENTS 4,146,862 3/1979 Mikulecky ..... 337/158

*Primary Examiner*—Harold Broome

*Attorney, Agent, or Firm*—Banner, Birch, McKie & Beckett

[57] ABSTRACT

A high voltage quick-break fuse has at least one silver fuse element and at least one tin fuse element in series connection. It is a full-range fuse dimensioned in such a way that, even in the case of critical overcurrents where hitherto fuses have had a tendency to explode, the in each case appropriate fuse element system comes into action, before the fuse can explode as a result of the rising internal pressure. Further developments relate to the housing of particularly thin silicone sleeves, supported by a fabric, in fuse tubes according to the DIN standard.

8 Claims, 8 Drawing Figures

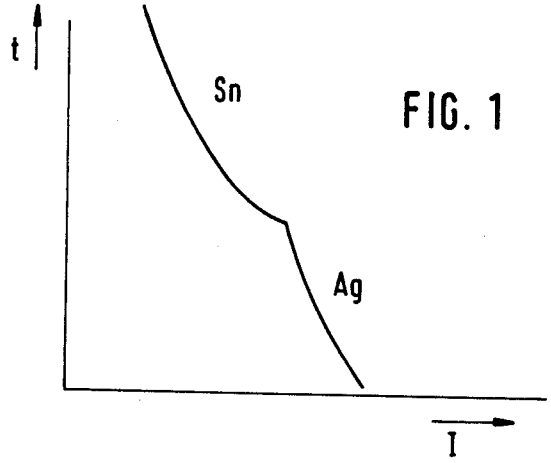
FIG. 1
FIG. 2b
FIG. 2a
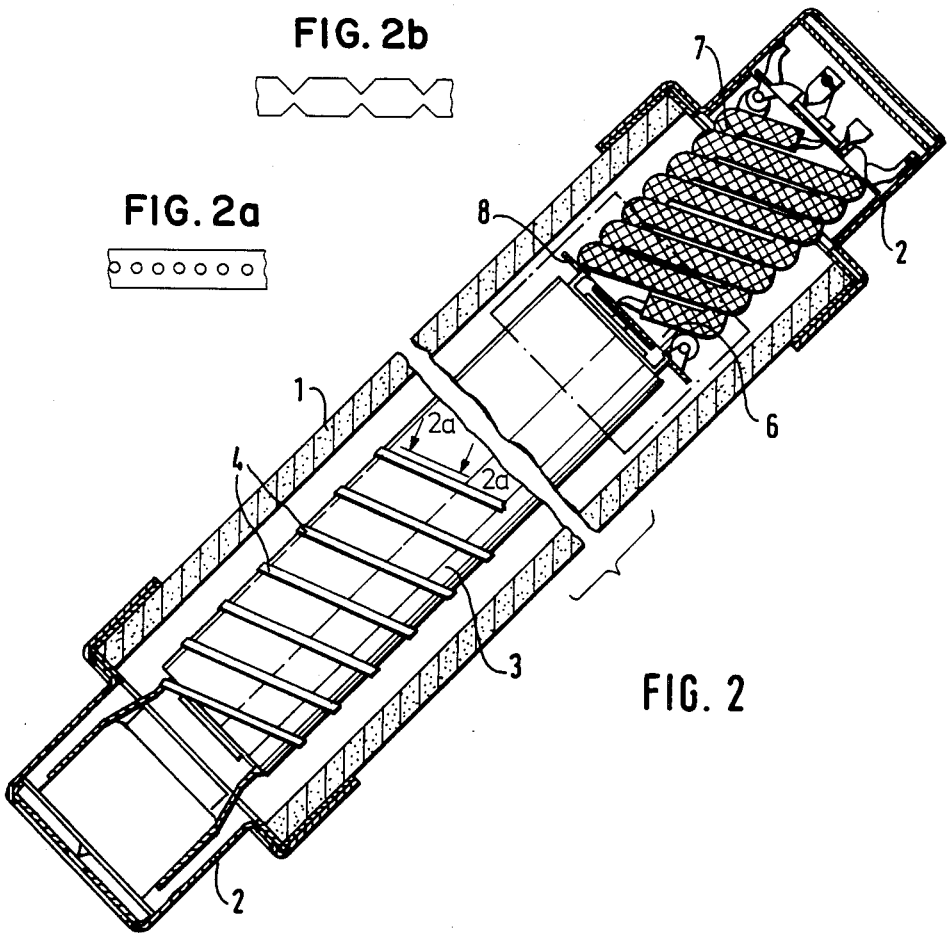
FIG. 2

HIGH VOLTAGE QUICK-BREAK FUSE

BACKGROUND OF THE INVENTION

The invention relates to a high voltage quick-break fuse with at least one silver fuse element and at least one tin fuse element in series connection, the silver fuse element being notched or perforated at intervals to influence its characteristics and the tin fuse element being surrounded by an arc-quenching or extinguishing material.

Such fuses are intended to break both extreme short-circuit currents and also overload currents only slightly above the rated current, so that they are also referred to as full-range fuses. More particularly as a result of the chosen melting point for the two series-connected fuse elements or fuse element groups, the tin fuse element is responsible for quenching under relatively low overcurrents, whilst the silver fuse element responds under extreme short-circuit currents (German Pat. No. 24 12 688). One of the most important requirements for a full-range fuse is that it brings about the break or interruption without any explosion-like self-destruction, i.e. undergoes no external changes.

It has been found that although the hitherto proposed fuses operate satisfactorily in the top and bottom overcurrent range, in a median range both fuse elements or fuse element groups react to the overcurrent, without the desired break taking place prior to an explosion. This process briefly takes place in the following way. The critical overcurrent is not sufficient to evaporate the tin fuse element in a more or less instantaneous manner, or to produce a large interruption point by fusing. Within the silver fuse element, the overcurrent is also not sufficient to produce an adequately large interruption to bring about a breaking process, so that the silver fuse element is initially only opened in the vicinity of a single constriction, which is formed by notches or a perforation. A stationary arc is formed at this point, which starts to melt and carbonize the surrounding sand filling, so that in spite of the interruption of the silver fuse element, this point is permanently conductive. This process is continued and it must be borne in mind that a powerful arc is present throughout this period. Before the tin fuse element, due to its slow response, finally brings about a separation, the arc emanating from the vicinity of the silver fuse element has often attacked and decomposed the quenching sleeve of the tin fuse element to such an extent that an interruption of the current in the tin/silicone system is no longer possible, and due to the internal pressure within the fuse, the latter explodes. Thus, as a result of the destructive action from the area of the silver fuse element, the separating action from the area of the tin fuse element comes too late to protect the fuse against explosion.

SUMMARY OF THE INVENTION

The problem of the invention is therefore to propose a fuse of the aforementioned type, which really earns its name of full-range fuse, i.e. interrupts the overcurrent in the critical overcurrent range, without an explosion.

According to the invention this problem is solved in that the ratio of the total of the cross-sections of all of the tin fuse elements to the total of the unrestricted cross-sections of all of the silver fuse elements is greater than 6, the ratio of the cross-sections of all of the tin fuse elements to the restricted cross-sections of all of the silver fuse elements is greater than 15, and the ratio of the total of the cross-sections of all of the tin fuse elements to the restricted cross-section of a single silver fuse element is greater than 60, but smaller than 85.

On considering the first feature of the invention, according to which the ratio of the total of the cross-sections of all tin fuse elements to the total of the unrestricted cross-sections of all silver fuse elements is greater than 6 and the ratio of the cross-sections of all the tin fuse elements to the restricted cross-sections of all the silver fuse elements is greater than 15, it is clear that the silver fuse elements brings about the disconnection in the case of short circuit-type currents, whilst in the case of overcurrents just above the rated current the separation is brought about by the tin fuse elements. In other words, in the case of extreme short-circuit currents, the melting and quenching effects of the silver fuse elements must be smaller than the melting effects of the tin fuse elements. As the size of the quenching effects is always dependent on the total cross-section of a fuse element and the size of the melting effects is dependent on the residual cross-section of a fuse element, the aforementioned first feature of the invention leads to the desired functional separation under extreme short-circuit currents or overcurrents just above the rated current. For the critical range of medium overcurrents, in which the hitherto known multi-range fuses have always tended to explode prior to a separation, the dimensioning according to this first feature is not sufficient and it is instead necessary to add a further dimensioning rule, so that the interruption occurs before an explosion in the case of these critical overcurrents.

The general condition for such a fuse is that the tin fuse elements always bring about the interruption of the overcurrent, if, due to the low energy level introduced, the silver fuse elements are unable to bring about quenching, although it can produce arcs. The desired effect occurs if the second feature of the invention is taken into consideration, according to which the ratio of the total of the cross-sections of the tin fuse element to the restricted cross-section of a single silver fuse element is greater than 60, but smaller than 85.

It is pointed out that in the case of this second feature, the total of the cross-sections of all the tin fuse elements is related to the restricted cross-section of a single silver fuse element. Generally tin fuse elements are not notched or perforated, so that here the residual cross-section coincide. However, this is not the case with the silver fuse elements, where perforations or notches are fundamentally present. In the case of several parallel-connected silver fuse elements, in the case of adequate overcurrents there is a so-called commutative effect, in which successively a plurality of silver fuse elements is cut out until a single silver fuse element is left for completing the final separation. Thus, it is a question of the ratio of the total cross-sections of all the tin fuse elements to the remaining smallest cross-section of the last remaining silver fuse element left in the given range.

Thus, in practice, as a result of the dimensioning according to the invention relatively large tin fuse element cross-sections are present compared with the restricted cross-sections of a single silver fuse element. Thus, the momentary response of the total tin fuse element is displaced towards relatively high currents, so that in each case there is a relatively large overload of the total silver fuse elements. It is always sufficient to bring about a quenching process, or in other words the currents which occur exceed the $I_{min}$ for the silver fuse element. The relatively generous dimensioning of the total tin fuse element influences its response to a negligible extent in the case of relatively low currents, in that it is surrounded by a silicone sheath, which forms a good thermal insulation and leads to an accumulation of heat within the tin fuse element, so that rapid melting occurs.

Obviously the increase in the cross-section of the total tin fuse element cannot be extended to such an extent that the system does not respond, even in the case of low overcurrents. Therefore the teaching of the invention limits the ratio according to the second feature to 85. A thermal conductivity coefficient between each tin fuse element and the surrounding silicone sheath of approximately 0.25 kcal/m.h.°K. is used as a basis. With higher thermal conductivity coefficients, this ratio is lower, whereas it is higher with lower thermal conductivity coefficients. However, it is always possible to consider the high voltage quick-break fuse according to the invention as a full-range fuse, because within the critical overcurrent range it always brings about a cut out before an explosion occurs. For example, it is suitable for the fuse protection of a 500 kVA transformer at an operating voltage of 12 kV, in which said critical current is at approximately 300 A. However, fuses dimensioned according to the invention are also suitable for larger transformer capacities of 1000 kVA.

When providing fuse protection against lower overcurrents, in which the tin fuse element system responds, a hot gas jet passes out of the silicone sleeves surrounding each tin fuse element and this has a particularly damaging effect on adjacent silicone coverings. In order to achieve optimum conditions here, according to a further development of the invention the ends of the tin fuse elements are always directed towards the free space within the fuse tube and are directed away from the covering of the adjacent conductor.

The dimensioning arrangements proposed by the invention lead to relatively strong tin fuse elements, which have corresponding large space requirements. It is always more difficult to house these fuse elements, including their silicone coverings in fuse tubes, whose dimensions are based on the relevant DIN standard. To combat this problem, a further development of the invention proposes that the silicone sleeves are made with relatively thin walls, but have a hose-like fabric to support the same and which can e.g. be spun or braided round the silicone sleeve in two-ply form. Thus, the quenching action of the silicone is fully retained, but bursting under the high gas pressure in the case of an arc within the silicone sleeve is prevented. It has been proved advantageous if the first fabric ply is relatively elastic, whilst the second outer ply fulfils the actual support function.

BRIEF DESCRIPTION OF THE DRAWINGS

The invention is described in greater detail hereinafter relative to non-limitative embodiments and with reference to the attached drawings, wherein show:

FIG. 1 a graph of the current - time behaviour of a full-range fuse on a logarithmic scale.

FIG. 2 a cross-sectional view through the full-range fuse dimensioned according to the invention.

FIG. *2a* is a side view of a perforated silver fuse element taken from line *2a*—*2a* on FIG. 2.

FIG. *2b* is a side view of an alternative silver fuse element wherein the edges of the element are notched at intervals therealong.

FIG. *3a* a part view of a tin fuse element according to FIG. 2.

FIG. *3b* a sectional view of the tin fuse element of the fuse according to FIG. *3a*.

Figure 3A:
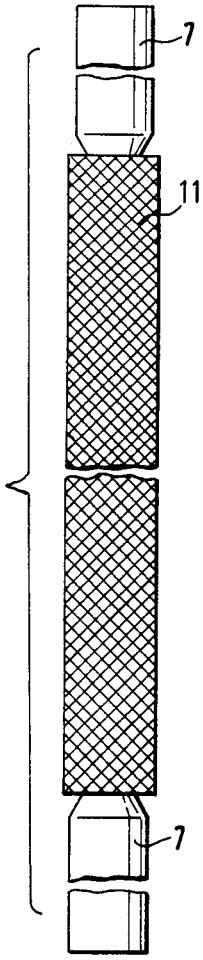
Figure 4:
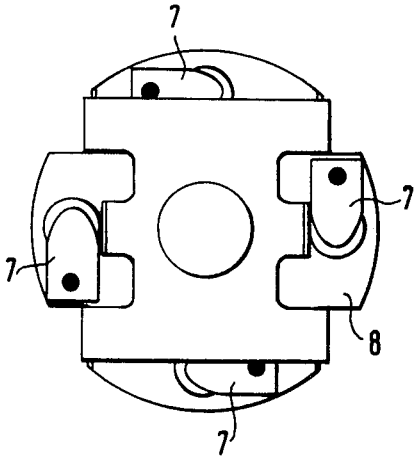

FIG. 4 a plan view of the tin fuse system of the fuse according to FIG. 2.

Figure 5:
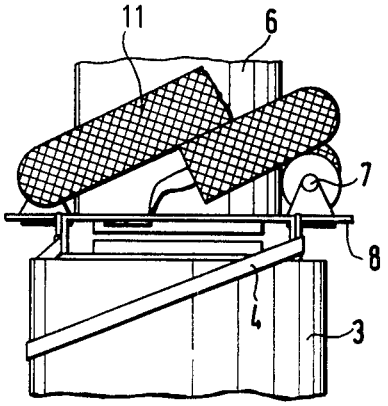
Figure 3B:
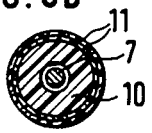

FIG. 5 an enlargement of the cutout of the transition point between the silver fuse element system and the tin fuse element system of the fuse according to FIG. 2.

FIG. 1 shows that the overall characteristic of a full-range fuse is formed from two partial characteristics. The critical overcurrents occur in the area on either side of the intersection of the two partial characteristics. In connection with these critical overcurrents, the invention proposes a dimensioning, which ensures that the appropriate quenching system of the two systems combined within the fuse always responds.

Such a fuse is shown in cross-section in FIG. 2. Externally it comprises a glass or ceramic fuse tube 1, whose two ends are closed by metal caps 2. Within the fuse tube is provided on one side a first former 3, which in the represented embodiment carries two silver fuse elements 4 wound on to it. Fuse elements 4 are perforated or notched at regular intervals and are cross-sectionally rectangular. In order to obtain a low $I_{min}$, it is advantageous to have a larger number of silver fuse elements 4, e.g. four such elements, but only two are shown in order not to overburden the drawing. In the other part of the fuse tube 1, there is a second former 6, to which are applied four sheathed tin fuse elements 7. One set of ends of the tin fuse elements 7 are welded to a metal cap 2, whilst the other ends are connected to a mounting flange 8, to which are also connected the two silver fuse elements 4. The ends of the silver fuse elements on the opposite side are fitted to the other metal cap 2.

FIG. *3a* and *b* show a tin fuse element 7 in the unwound, extended state, which carries as a sheath a silicone sleeve 10, over which is placed a double fabric ply 11. Silicone sleeve 10 is made relatively thin for the quenching function which it has to fulfil and this is compensated by the surrounding support fabric 11. The latter is spun or braided round the silicone sleeve 10, the first ply being made more elastic than the second outer ply, due to the selected thread position. As a result, in the case of an internal gas pressure, the silicone sleeve 10 can inflate by a certain amount, until this expansion movement is stopped by the second fabric ply. As a result of this metered expansion, stress peaks within the silicone sleeve 10 are reduced, thereby greatly decreasing the risk of bursting.

FIG. 4 particularly clearly shows the way in which the sheathed tin fuse elements 7 are combined on mounting flange 8. Together with the associated second former 6, they form a unit, which can easily be flanged to the former 3 for the silver fuse elements 4.

FIG. 5 shows on a larger scale the transition between the two formers 3 and 6. It is easy to see the distinction of the tin fuse element ends, which are directed towards the free space outside the turns, but are not directed on the silicone sleeve 10 of the adjacent tin fuse element 7. If hot gases escape from the ends of the silicone sleeve 10, when the tin fuse element system responds, they do not come into contact with a silicone sleeve 10 from the outside and are instead expelled into the free space within fuse tube 1. Thus, the fabric ply and the silicone hose remain substantially undamanged, so that they can perform their quenching function without being impaired from the outside.

What is claimed is:

1. A high voltage quick-break fuse comprising: a fuse tube, at least one silver fuse element and at least one tin fuse element in series connection mounted within said tube, said silver fuse element having restricted cross-section areas at intervals along said silver fuse element to influence its characteristics and said tin fuse element being surrounded by an arc-quenching material, wherein the ratio of the total cross-sections of all the tin fuse elements to the total cross-sections of all the silver fuse elements is greater than 6, the ratio of the total cross-sections of all the tin fuse elements to the restricted cross-section area of all the silver fuse elements is greater than 15, and the ratio of the total cross-sections of all the tin fuse elements to the restricted cross-section area of a single silver fuse element is greater than 60, but smaller than 85.

2. A fuse according to claim 1, wherein there are four silver fuse elements and four tin fuse elements.

3. A fuse according to claim 2, wherein the ends of the tin fuse elements are mounted to point towards a free space within said fuse tube and be directed away from said arc-quenching material covering of adjacent tin fuse elements.

4. A fuse according to any one of claims 1, 2 or 3 wherein said arc-quenching material surrounding each tin fuse element is provided by a relatively thin wall silicone sleeve, said sleeve being surrounded by a hose-like fabric in order to support said sleeve.

5. A fuse according to claim 4, wherein said fabric is formed from two plys applied by braiding or spinning, and the outer ply is less elastic than the inner ply.

6. A fuse according to claim 4 wherein all of the tin fuse elements are applied to a former having a mounted flange, and the silver fuse elements are applied to a former which faces said mounting flange.

7. A fuse according to claims 1, 2 or 3 wherein said restricted cross-section areas of said silver fuse element are produced by perforations at intervals along said silver fuse element.

8. A fuse according to claims 1, 2 or 3 wherein said restricted cross-section areas of said silver fuse element are provided by notches at intervals along said silver fuse element.

* * * * *